United States Patent [19]

Chow

[11] Patent Number: 4,461,262

[45] Date of Patent: Jul. 24, 1984

[54] FUEL TREATING DEVICE

[76] Inventor: Edward Chow, 1009 W. 47th Ave., Vancouver, British Columbia, Canada, V6M 2L3

[21] Appl. No.: 225,786

[22] Filed: Jan. 16, 1981

[51] Int. Cl.[3] ..... F23D 21/00; F02B 75/10

[52] U.S. Cl. ..... 123/536; 123/538; 123/539

[58] Field of Search ..... 123/536, 537, 538, 539; 210/222; 431/356

[56] References Cited

U.S. PATENT DOCUMENTS

| | | | |
|---|---|---|---|
| 3,059,910 | 10/1962 | Moriya | 123/536 |
| 3,060,339 | 10/1962 | Moriya . | |
| 3,110,294 | 11/1963 | Nyman | 123/536 |
| 3,116,726 | 1/1964 | Kwartz | 123/536 |
| 3,228,868 | 1/1966 | Ruskin | 123/536 |
| 3,349,354 | 10/1967 | Miyata | 123/538 |
| 3,830,621 | 8/1974 | Miller | 123/539 |
| 3,989,017 | 11/1976 | Reece | 123/536 |
| 4,050,426 | 9/1977 | Sanderson | 123/538 |
| 4,201,140 | 5/1980 | Robinson . | |

FOREIGN PATENT DOCUMENTS

| | | | |
|---|---|---|---|
| 2108450 | 11/1971 | Fed. Rep. of Germany . | |
| 835386 | 12/1938 | France | 123/536 |
| 153850 | 12/1980 | Japan | 123/538 |
| 814269 | 6/1959 | United Kingdom | 123/536 |

*Primary Examiner*—Ronald H. Lazarus

*Attorney, Agent, or Firm*—Seed and Berry

[57] ABSTRACT

A fuel treating device comprises two pairs of magnets, one pair positioned on each inlet for fuel and oxygen so that the incoming fuel is exposed to a magnetic field. Each pair of magnets is positioned diametrically opposed about the inlet line with the south magnetic pole of each magnet placed upstream furthest away from the mixing zone. The magnets are insulated from each other and from the inlet line by nonmagnetic materials, such as Neoprene, which do not disrupt the magnetic field.

14 Claims, 2 Drawing Figures

FUEL TREATING DEVICE

TECHNICAL FIELD

This invention relates to an improvement in fuel combustion caused by subjecting both the fuel and oxygen entering a combustion chamber to a longitudinal magnetic field. The invention more particularly relates to placing a pair of magnets substantially diametrically opposed around the fuel and oxygen inlet lines so that the south magnetic pole of each magnet is furthest from the combustion chamber.

BACKGROUND ART

With the increase in fuel cost and the increase in environmental consciousness, many devices to improve fuel economy or to reduce pollution have arisen. Many patents use magnetism to improve combustion. For example, in U.S. Pat. No. 3,830,621 (Miller), the oxygen-containing gas is passed through a magnetic field to place the oxygen in the south pole magnetic state. Miller states that the south pole magnetic state is essential to increased combustion efficiency. As shown in FIG. 9, Miller mounts his magnets radially so that gases passing through the inlet line are exposed to flux from only one pole of a magnet. Alternatively, he employs an annular magnet which serves as the oxygen inlet.

A second example of the use of magnetism to enhance combustion is disclosed in U.S. Pat. No. 4,188,296 (Fujita). Magnets in the shape of horseshoes are mounted around fuel lines to apply a magnetic field to the fuel. A special yoke to produce a variable flux density of at least ten Gauss traverses the pipe. Optionally, the magnetic field may be applied to a steam or an air feed for the combustion device. Fujita fails, however, to use opposed magnetic poles.

Still other examples of devices employing magnetism to improve fuel combustion are:

U.S. Pat. No. 4,050,426 (Sanderson)
U.S. Pat. No. 3,349,354 (Miyata)
U.S. Pat. No. 3,266,783 (Knight)
U.S. Pat. No. 3,177,633 (McDonald, Jr.)
U.S. Pat. No. 3,116,726 (Kwartz)
U.S. Pat. No. 3,059,910 (Moriya)

Placing cow magnets on the inlet fuel line has been widely publicized as a way to increase fuel economy.

SUMMARY OF THE INVENTION

According to this invention, it has been found that the proper positioning and orientation of the magnets to produce the proper magnetic field is critical to obtaining more optimum fuel efficiency. A pair of magnets are diametrically positioned on the fuel inlet line so that the south magnetic pole of each magnet is furthest from the combustion chamber. Two magnets are similarly placed on the oxygen inlet. Each magnet preferably has an insulating coating so that it is better protected against magnetic interference from the inlet line. In this orientation, the magnets treat the fuel to improve combustion better than previously disclosed devices. After passage through this magnetic field, the oxygen is not in a south pole magnetic state.

The fuel treating device of this invention is inexpensive, easy to install, easy to maintain, and readily retrofit to existing combustion chambers, such as automobile engines or small vehicle two-cycle engines. In fact, installation takes only a matter of minutes without modification to existing equipment. Fine tuning the placement of the magnets is easily accomplished.

BEST MODE FOR CARRYING OUT THE INVENTION

U.S. Pat. No. 3,830,621 is incorporated by reference herein. The fuel treating device of this invention may be used in any combustion device where a hydrocarbon fuel and an oxygen-containing fluid are mixed prior to combustion. Pairs of magnets mounted on the inlets before the mixing zone densify the fuels to promote more efficient combustion. Fuel economy is increased; pollutants are decreased.

In achieving a system which operates effectively, it has been found that magnets need be placed on both the hydrocarbon fuel inlet and the oxygen inlet. Magnetizing only the oxygen or fuel fails to achieve the best combustion efficiency. Also, it has been found that the magnets need be particularly oriented to achieve the optimal efficiency.

Figure 1:
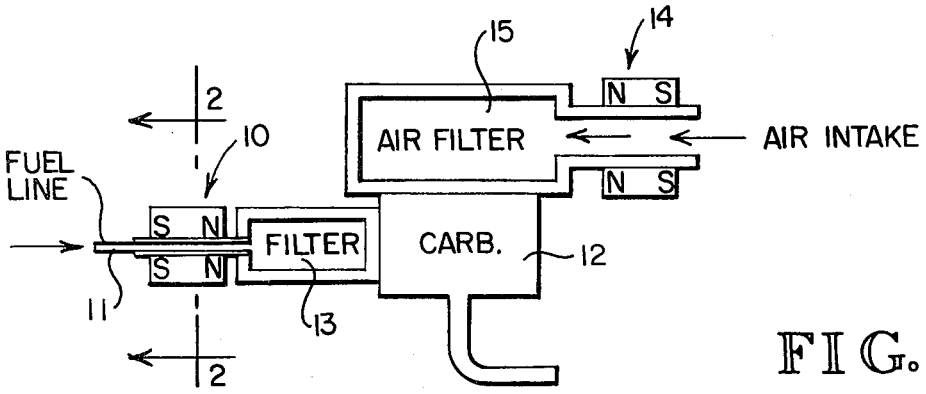
FIG. 1 shows schematically the position of the magnets on an internal-combustion engine.

Referring now to FIG. 1, a pair of longitudinal magnets 10 are positioned about the fuel line 11 of an internal-combustion engine. Each magnet 10 has its south pole (S) upstream from the carburetor 12. Fuel passes initially through the flux of these opposed south poles, and then through the field of opposed north poles (N). The magnets 10 should be placed as close to the mixing zone as possible. The magnets 10 on an internal-combustion engine are positioned as close to the gas filter 13 as possible. If the engine were a diesel, the magnets 10 would be placed next to the carburetor 12 (there being no gas filter 13). Because different sizes and types of engines consume fuels at different rates and because various engines have different configurations, it is impossible to define a precise location for the magnets 10 with respect to the mixing zone. However, placing them as close as possible initially and fine tuning their position with experience will yield the optimum location without undue experimentation.

As shown in FIG. 1 for an internal-combustion engine, a pair of magnets 14 are also positioned on the air filter scoop 15 to expose the inlet oxygen to a magnet field. As with the magnets 16 on the fuel line 11, this pair of magnets 14 has the south pole (S) of each magnet furthest upstream from the carburetor 12. The magnets 14 are longitudinally positioned and are substantially diametrically opposed to one another. They are placed as near to the carburetor as the air scoop 15 will allow. Again, fine tuning for the optimal positioning will be required as with the fuel inlet magnets 10.

EXAMPLE 1

A pair of 1000 Gauss M-type Hexagonal Ferrite ceramic magnets were positioned one inch (2.54 cm) from the gas filter on a Ford 460-cubic inch (7300 $cm^3$), 8-cylinder engine. A second pair 1000 Gauss ceramic magnets were positioned one-half inch (1.27 cm) from the rim of the air cleaner. A 19.6% increase in fuel economy was detected.

EXAMPLE 2

A pair of 1000 Gauss ceramic magnets were positioned one inch (2.54 cm) from the carburetor of a 90-cubic inch (1400 $cm^3$) Volkswagen diesel engine. A second pair of 1000 Gauss ceramic magnets were positioned one-half inch (1.27 cm) from the rim of the air cleaner. A 22.2% increase in fuel economy was detected.

Figure 2:
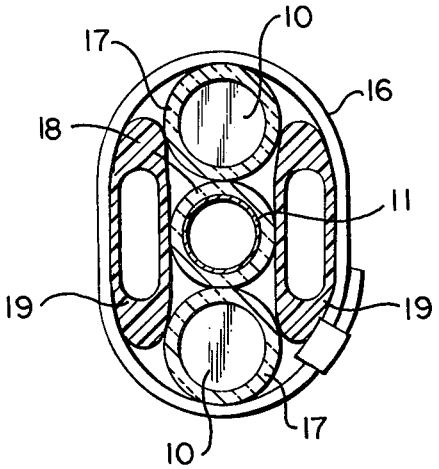
FIG. 2, a section along line 2—2 of FIG. 1, shows one means of positioning the magnets used in this invention.

As seen in FIG. 2, each pair of magnets 10 is held around the inlet 11 with a hose clamp 16 or other suitable means capable of keeping the magnets substantially diametrically opposed. To avoid undue interference between the magnets and their surroundings, each magnet preferably is insulated with a nonmagnetic material 17 which will not disrupt the magnetic flux. Alternatively, the inlet 11 may be insulated 18 so that there is no direct contact between the magnets 10 and the line 11. Suitable insulators 17 or 18 are Neoprene automotive hose and other flexible line, electrical tape, or duct tape. The insulator should be able to withstand the operating temperatures to which it is exposed. To keep the magnets 10 apart and substantially diametrically opposed, spacers 19, such as neoprene hose, are placed between the magnets 10. As the clamp 16 is tightened, the spacers 19 will compress to assure that a locking fit is attained. Use of this type of clamp allows the magnets 10 and 14 to be quickly installed without modification to the engine and with commonly available, inexpensive parts.

The magnets 10 or 14 should have a Curie temperature sufficiently high that they retain their magnetic characteristics at the operating temperatures to which they are exposed. For example, in an automobile engine the fuel line magnets 10 will lie above the engine block where radiative heating will greatly increase their temperature. Some magnets lose much of their magnetic field strength as their temperatures rise. These types of magnets should be avoided. Again, a standard cannot be set because combustion devices vary so greatly. Any permanent magnet or electromagnet which will maintain its field strength may be used. The field strength will vary widely for the type of engine. For small model toy engines, magnets with about 5–10 Gauss are satisfactory. For larger engines, 3000, 5000 or even 10,000 Gauss or more may be required. The field strength is a function of the engine size based on fuel consumption. Ceramic or metallic magnets are preferred, especially aluminum-cobalt-nickel alloy magnets, which are commonly available.

The utility of this invention should not be limited to automotive engines. The magnets densify the incoming fuels to allow more efficient, cleaner combustion. They may be placed on any inlet lines for combustion chambers upstream of the mixing zone. Treatment after mixing has been found to be less effective.

Those skilled in the art will recognize numerous modifications to the preferred embodiment shown and described. Therefore, this invention should not be limited unless limitation is necessary due to the prior art or the nature and spirit of the appended claims.

I claim:

1. A fuel treating device for a combustion chamber having a hydrocarbon fuel inlet line and an oxygen inlet line, comprising:

a pair of substantially diametrically opposed magnets longitudinally positioned around the fuel inlet line with the south magnetic pole of each magnet located furthest from the combustion chamber; and a pair of substantially diametrically opposed magnets longitudinally positioned around the oxygen inlet line with the south magnetic pole of each magnet located furthest from the combustion chamber.

2. The fuel treating device as defined in claim 1, further comprising nonmagnetic spacers to retain the magnets substantially diametrically opposed.

3. The fuel treating device of claim 1 or claim 2 wherein each magnet has a layer of insulation enclosing it.

4. The fuel treating device of claim 1 or claim 2 wherein the fuel inlet line and oxygen inlet line are insulated from direct contact with the magnets.

5. The fuel treating device of claim 1 wherein the magnets are permanent magnets having a Curie temperature sufficiently high that they retain their magnetic characteristics at the operating temperature of the combustion chamber.

6. The fuel treating device of claim 1 wherein each magnet is an electromagnet.

7. The fuel treating device of claim 1 wherein the combustion chamber is in an internal-combustion engine including a carburetor.

8. The fuel treating device of claim 7 wherein the magnets are positioned as close to the carburetor as possible without modifying the standard components of the engine.

9. The fuel treating device of claim 2 wherein the pairs of magnets are positioned about the inlets with hose clamps.

10. A fuel treating device for an automobile internal-combustion engine having a combustion chamber, a hydrocarbon fuel inlet line, and an air inlet line, comprising:

a pair of substantially diametrically opposed, longitudinal, permanent magnets longitudinally positioned around the fuel inlet line, with the south magnetic pole of each magnet located furthest from the combustion chamber; and a pair of substantially diametrically opposed, longitudinal, permanent magnets longitudinally positioned arount the air inlet line, with the south magnetic pole of each magnet located furthest from the combustion chamber, wherein each magnet has a Curie temperature sufficiently high that the magnet retains its magnetic characteristics at the operating temperatures of the engine and wherein each magnet is positioned as close to the combustion chamber as possible without modifying the standard components of the engine.

11. The device of claim 10 wherein the device is retrofit to an engine by attaching the magnets in their proper locations on the air and fuel inlets with a suitable clamp.

12. The deivce of claim 11 wherein the clamp includes means for ensuring that the magnets remain substantially diametrically opposed about their respective inlet.

13. The device of claim 12 wherein the clamp is a hose clamp, the means for ensuring the positioning include nonmagnetic spacers, and the magnets include a layer of insulation to substantially completely encapsulate each magnet.

14. The device of claim 13 wherein each inlet includes a layer of insulation in the area where the magnets are positioned.

* * * * *